US005911840A

United States Patent [19]

Couderchon et al.

[11] Patent Number: 5,911,840

[45] Date of Patent: Jun. 15, 1999

[54] PROCESS FOR MANUFACTURING A MAGNETIC COMPONENT MADE OF AN IRON-BASED SOFT MAGNETIC ALLOY HAVING A NANOCRYSTALLINE STRUCTURE

[75] Inventors: Georges Couderchon; Philippe Verin, both of Sauvigny lès Bois, France

[73] Assignee: Mecagis, Puteaux, France

[21] Appl. No.: 08/989,083

[22] Filed: Dec. 11, 1997

[30] Foreign Application Priority Data

Dec. 11, 1996 [FR] France ..... 96 15197

[51] Int. Cl.[6] ..... H01F 1/147

[52] U.S. Cl. ..... 148/121; 148/108

[58] Field of Search ..... 148/108, 121, 148/122

[56] References Cited

U.S. PATENT DOCUMENTS

| | | | |
|---|---|---|---|
| 4,262,233 | 4/1981 | Becker et al. . | |
| 5,252,144 | 10/1993 | Martis | 148/121 |
| 5,340,413 | 8/1994 | Martis | 148/305 |
| 5,611,871 | 3/1997 | Yoshizawa et al. | 148/108 |
| 5,725,686 | 3/1998 | Yoshizawa et al. | 148/307 |

OTHER PUBLICATIONS

IEEE Transactions on Magnetics, vol. 29, No. 6, Nov. 1, 1993, pp. 2670–2672, Heczko et al.: "Magnetic Properties of Compacted Alloy $Fe_{73.5}CU_1NB_3Si1_{3.5}B_9$ In Amorphous and Nanocrystalline State".

Patent Abstracts of Japan, vol. 009, No. 178 (E–330), Jul. 23, 1985 & JP 60 047 407 A (Matsushita Denko KK).

*Primary Examiner*—John Sheehan

*Attorney, Agent, or Firm*—Oblon, Spivak, McClelland, Maier & Neustadt, P.C.

[57] ABSTRACT

Process for manufacturing a magnetic component made of an iron-based soft magnetic alloy having a nanocrystalline structure, the chemical composition of which is, in at. %, Fe≧60%, 0.1%≦Cu≦3%, 0%≦B≦25%, 0%≦Si≦30%, and at least one element selected from niobium, tungsten, tantalum, zirconium, hafnium, titanium and molybdenum with contents of between 0.1% and 30%, the balance being impurities resulting from the smelting, the composition furthermore satisfying the relationship 5%≦Si+B≦30%, according to which an amorphous ribbon is manufactured from the magnetic alloy, a blank for a magnetic component is manufactured from the ribbon and the magnetic component is subjected to a crystallization heat treatment comprising at least one annealing step at a temperature of between 500° C. and 600° C. for a temperature hold time of between 0.1 and 10 hours so as to cause nanocrystals to form; before the crystallization heat treatment, a relaxation heat treatment is carried out at a temperature below the temperature for the onset of recrystallization of the amorphous alloy.

6 Claims, No Drawings

PROCESS FOR MANUFACTURING A MAGNETIC COMPONENT MADE OF AN IRON-BASED SOFT MAGNETIC ALLOY HAVING A NANOCRYSTALLINE STRUCTURE

FIELD OF THE INVENTION

The present invention relates to the manufacture of magnetic components made of an iron-based soft magnetic alloy having a nanocrystalline structure.

PRIOR ART

Nanocrystalline magnetic materials are well-known and have been described, in particular, in European Patent Applications EP 0,271,657 and EP 0,299,498. These are iron-based alloys containing more than 60 at.% (atom %) of iron, copper, silicon, boron and, optionally, at least one element selected from niobium, tungsten, tantalum, zirconium, hafnium, titanium and molybdenum, which are cast in the form of amorphous ribbons and then subjected to a heat treatment which causes extremely fine crystallization (the crystals are less than 100 nanometres in diameter) to occur. These materials have magnetic properties which are particularly suitable for manufacturing soft magnetic cores for electrical engineering appliances, such as residual-current circuit breakers. In particular, they have an excellent magnetic permeability and may have either a broad hysteresis loop ($Br/Bm \geqq 0.5$) or a narrow hysteresis loop ($Br/Bm \leqq 0.3$), Br/Bm being the ratio of the remanent magnetic induction to the maximum magnetic induction. Broad hysteresis loops are obtained when the heat treatment consists of a single annealing step at a temperature of between 500° C. and 600° C. Narrow hysteresis loops are obtained when the heat treatment includes at least one annealing step in a magnetic field, this annealing step possibly being the annealing intended to cause nanocrystals to form.

Nanocrystalline ribbons, or more precisely the magnetic components manufactured from these ribbons, have, however, a drawback which limits their use. This drawback is that the magnetic properties are insufficiently stable when the temperature rises above ambient temperature. This insufficient stability results in a lack of functional reliability of residual-current circuit breakers equipped with such magnetic cores.

SUMMARY OF THE INVENTION

The object of the present invention is to remedy this drawback by providing a means for manufacturing magnetic cores made of a nanocrystalline material having magnetic properties, the temperature stability of which is considerably improved.

For this purpose, the subject of the invention is a process for manufacturing a magnetic component made of an iron-based soft magnetic alloy having a nanocrystalline structure, the chemical composition of which comprises, in at. %, $Fe \geqq 60\%$, $0.1\% \leqq Cu \leqq 3\%$, $0\% \leqq B \leqq 25\%$, $0\% \leqq Si \leqq 30\%$, and at least one element selected from niobium, tungsten, tantalum, zirconium, hafnium, titanium and molybdenum with contents of between 0.1% and 30%, the balance being impurities resulting from the smelting, the composition furthermore satisfying the relationship $5\% \leqq Si+B \leqq 30\%$, according to which:

an amorphous ribbon is manufactured from the magnetic alloy, a blank for a magnetic component is manufactured from the ribbon and the magnetic component is subjected to a crystallization heat treatment comprising at least one annealing step at a temperature of between 500° C. and 600° C. for a temperature hold time of between 0.1 and 10 hours so as to cause nanocrystals to form; and before the crystallization heat treatment, a relaxation heat treatment is carried out at a temperature below the temperature for the onset of recrystallization of the amorphous alloy.

The relaxation heat treatment may be a temperature hold for a time of between 0.1 and 10 hours at a temperature of between 250° C. and 480° C.

The relaxation heat treatment may also consist of a gradual heating from ambient temperature up to a temperature above 450° C., at a heating rate of between 30° C./hour and 300° C./hour between 250° C. and 450° C.

Depending on the magnetic properties desired, in particular depending on the desired shape of the hysteresis loop, and in accordance with the state of the art, at least one annealing step constituting the heat treatment may be carried out in a magnetic field.

This process applies more particularly to the iron-based soft magnetic alloys having a nanocrystalline structure whose chemical composition is such that $Si \leqq 14\%$.

DESCRIPTION OF A PREFERRED EMBODIMENT

The invention will now be described in more detail, but in a non-limiting manner, and illustrated by examples.

To manufacture magnetic components in high volume, for example magnetic cores for an AC-class residual-current circuit breaker (sensitive to alternating fault currents), a ribbon of soft magnetic alloy having an amorphous structure, capable of acquiring a nanocrystalline structure, is used, this alloy consisting mainly of iron in a proportion of greater than 60 at. % and furthermore containing:

from 0.1 to 3 at. %, and preferably from 0.5 to 1.5 at. %, of copper;

from 0.1 to 30 at. %, and preferably from 2 to 5 at. %, of at least one element chosen from niobium, tungsten, tantalum, zirconium, hafnium, titanium and molybdenum; preferably, the niobium content is between 2 and 4 at. %;

silicon and boron, the sum of the content of these elements being between 5 and 30 at. % and preferably between 15 and 25 at. %, it being possible for the boron content to be as high as 25 at. % and preferably being between 5 and 14 at. %, and the silicon content possibly reaching 30 at. %, and preferably being between 12 and 17 at. %.

Apart from these elements, the alloy may include low concentrations of impurities provided by the raw materials or resulting from the smelting.

The amorphous ribbon is obtained in a manner known per se by very rapid solidification of the liquid alloy, this being cast, for example, onto a cooled wheel.

The magnetic-core blanks are also manufactured in a manner known per se by winding the ribbon around a mandrel, cutting it and fixing its end using a spot weld, so as to obtain small tori of rectangular cross section.

In order to give the blanks their final magnetic properties, they are first subjected to an annealing step called "relaxation annealing" at a temperature below the temperature for the onset of crystallization of the amorphous strip, and preferably a temperature of between 250° C. and 480° C., and then to a crystallization annealing step which may or may not be carried out in a magnetic field and, optionally, may be followed by an annealing step at a lower temperature, carried out in a magnetic field. The inventors have, in fact found, entirely unexpectedly that this relaxation annealing has the advantage of very considerably reducing the sensitivity of the magnetic properties of the cores to temperature. The inventors have also found that the relaxation annealing prior to the recrystallization annealing has the additional advantage of reducing the scatter in the observed magnetic properties of the cores on high-volume manufacturing runs.

The crystallization annealing is intended to cause nanocrystals with a size of less than 100 nanometers, preferably of between 10 and 20 nanometers, to precipitate in the amorphous matrix. This very fine crystallization enables the desired magnetic properties to be obtained. The crystallization annealing consists of a temperature hold at a temperature above the temperature for the onset of crystallization and below the temperature for the onset of the appearance of secondary phases which degrade the magnetic properties. In general, the crystallization annealing temperature is between 500° C. and 600° C., but it may be optimized for each ribbon, for example by determining, by experiment, the temperature which leads to the maximum magnetic permeability. The crystallization annealing temperature may then be chosen so as to be equal to this temperature or, better still, be chosen so that it is approximately 30° C. above it.

In order to modify the shape of the hysteresis loop, something which is necessary for class A residual-current circuit breakers (those sensitive to biased fault currents), the crystallization annealing may be carried out in a transverse magnetic field. The crystallization treatment may also be completed by an annealing step at a temperature below the crystallization onset temperature, for example around 400° C., carried out in a transverse magnetic field.

More generally, the heat treatment of the magnetic-component blanks includes a relaxation annealing step, a crystallization annealing step optionally carried out in a magnetic field and, optionally, a complementary annealing step carried out in a magnetic field.

The relaxation annealing which precedes the crystallization annealing, and which may be carried out equally well on the amorphous ribbon itself as on the magnetic-component blank, may consist of a constant-temperature hold for a time which preferably must be between 0.1 and 10 hours. This annealing may also consist of a gradual temperature rise which precedes, for example, the crystallization annealing and which must be performed at a rate of temperature rise of between 30° C./h and 300° C./h, at least between 250° C. and 450° C.; preferably, the rate of temperature rise must be approximately 100° C./h.

In all cases, it is preferable to carry out the heat treatments in furnaces having a controlled, neutral or reducing, atmosphere.

By way of example, two ribbons of the alloy $Fe_{73}Si_{15}B_8Cu_1Nb_3$ (73 at. % of iron, 15 at. % of silicon, etc.), having a thickness of 20 $\mu$m and a width of 10 mm, obtained by direct quenching on a cooled wheel, were manufactured. Two series of blanks for magnetic cores were manufactured from each of the ribbons, these cores being labeled respectively A1 and A2 (for the first ribbon) and B1 and B2 (for the second ribbon) . The series of blanks for magnetic cores A1 and B1 were subjected to a heat treatment according to the invention, consisting of a relaxation annealing step of 3 hours at 400° C. followed by a crystallization annealing step of 3 hours at 530° C. The series of blanks for magnetic cores A2 and B2 were, by way of comparison, treated according to the Prior Art by a single crystallization annealing step of 3 hours at 530° C. The maximum 50 Hz magnetic permeability was measured on the four series of blanks for magnetic cores at different temperatures of between −25° C. and 100° C., and expressed as a percentage of the maximum 50 Hz magnetic permeability at 20° C. The results are as follows:

| Specimen | −25° C. | −5° C. | 20° C. | 80° C. | 100° C. |
|---|---|---|---|---|---|
| A1 (inv) | 100% | 102% | 100% | 93% | 86% |
| A2 (comp) | 102% | 103% | 100% | 87% | 78% |
| B1 (inv) | 97% | 98% | 100% | 88% | 78% |
| B2 (comp) | 98% | 99% | 100% | 75% | 60% |

These results have to be interpreted by examining separately the case for specimens A1 and A2 on the one hand, and specimens B1 and B2 on the other hand. This is because, although all the specimens are composed of the same alloy, two ribbons were used, these being manufactured separately and consequently having slightly different properties.

This said, it may be seen that, both for the group A1, A2 and the group B1, B2, the degradation in the magnetic permeability caused by heating to 80° C. or 100° C. is much less than in the case of the specimens according to the invention than in the case of the specimens given by way of comparison. At 100° C., for example, the loss in magnetic permeability is, for the specimens according to the invention, approximately half that for the specimens manufactured according to the prior art.

In addition to the effect obtained with regard to the temperature stability of the magnetic properties, the inventors have found that the invention improved the reproducibility of the magnetic properties of cores manufactured in high volume. This favorable effect will now be illustrated by the following two examples.

The first example relates to toric magnetic cores manufactured from ribbons 20 $\mu$m in thickness and 10 mm in width, obtained by direct quenching on a cooled wheel, of an alloy of composition (in at. %) $Fe_{73.5}Si_{13.5}B_9Cu_1Nb_3$. After quenching on the wheel, it was verified, using X-rays, that the ribbon was indeed completely amorphous. The ribbon was then split into three sections; one, A, remained in the as-quenched state and the other two, B and C, were subjected to a relaxation annealing step—in the case of one, B, of 1 hour at 400° C. and in the case of the other, C, of 1 hour at 450° C. The coercive field was measured, the minimum and maximum values of which were, in mOe (1 mOe= 0.079577 A/m):A, from 80 to 200 mOe, B and C, from 25 to 35 mOe. These results show the effect of the relaxation treatment which not only reduces the scatter in the coercive field but also very considerably reduces its value.

The three ribbon portions were then used to form blanks for toric magnetic cores, and these cores were firstly subjected to a crystallization annealing step of 1 hour at 530° C., in order to obtain a broad hysteresis loop, and then to an annealing step in a transverse magnetic field of 1 hour at 400° C., in order to obtain a narrow hysteresis loop. The values of the coercive field, the maximum 50 Hz permeability and, only for the narrow loops, the Br/Bm ratio (the ratio of the remanent induction to the saturation induction) were determined.

The results were as follows:

a) Broad loops:

| Specimen | Relaxation treatment | Coercive field (mOe) | Maximum 50 Hz permeability |
|---|---|---|---|
| A | none | 6.1 | 650,000 |
| B | 1 h at 400° C. | 5.2 | 690,000 |
| C | 1 h at 450° C. | 5.1 | 760,000 |

b) Narrow loops:

| Specimen | Relax. treat. | Coercive field (mOe) | Br/Bm | Max. 50 Hz perm. |
|---|---|---|---|---|
| A | none | 5 | 0.12 | 200,000 |
| B | 1 h at 400° C. | 3.8 | 0.08 | 215,000 |
| C | 1 h at 450° C. | 3.4 | 0.07 | 205,000 |

These results clearly show the improvement in the magnetic properties which is produced by the relaxation treatment: a decrease in the coercive field, an increase in the maximum permeability and a greater ease in obtaining narrow loops.

The second example relates to toric magnetic cores manufactured from ribbons 20 $\mu$m in thickness and 10 mm in width, obtained by direct quenching on a cooled wheel, of an alloy of composition (in at. %) $Fe_{73}Si_{15}B_8Cu_1Nb_3$.

Two batches of 300 tori having an inside diameter of 11 mm and an outside diameter of 15 mm, were manufactured using automatic winding machines. The batches were then treated in furnaces with a neutral atmosphere. A reference batch A was only subjected to a crystallization annealing step of 1 hour at 530° C. The second batch was treated according to the invention: a relaxation annealing step of 1 h at 400° C. was firstly carried out, followed by a crystallization annealing step of 1 h at 530° C. The tori were put into a housing and wedged in using a foam washer. For each batch, the average and the standard deviation of the maximum 50 Hz permeability was determined.

The results were as follows:

| Treatment | Max. 50 Hz permeability average | Max. 50 Hz permeability standard deviation |
|---|---|---|
| no relaxation (batch A) | 585,000 | 28,000 |
| with relaxation (batch B) | 615,000 | 20,000 |

They show the effect of the relaxation annealing which, on the one hand, improves the average value of the maximum permeability and, on the other hand, reduces the scatter.

Next, the two batches were treated for 1 hour at 400° C. in a transverse magnetic field so as to obtain narrow hysteresis loops. The coercive field, the Br/Bm ratio and the 50 Hz permeability at 5 mOe were measured. The results were as follows:

| Treatment | Coercive field (mOe) | Br/Bm | 50 Hz perm. in 5 mOe |
|---|---|---|---|
| without relaxation (batch A) | 5.2 | 0.08 | 117,000 |
| with relaxation (batch B) | 4.3 | 0.06 | 124,000 |

These results clearly show the improvement in the magnetic properties brought about by the relaxation treatment: a decrease in the coercive field, an increase in the 50 Hz permeability in 5 mOe and a greater ease of obtaining narrow loops.

We claim:

1. A process for manufacturing a magnetic component comprising an iron-based soft magnetic alloy having a nanocrystalline structure the chemical composition of which is, in at. %, $Fe \geqq 60\%$, $0.1\% \leqq Cu \leqq 3\%$, $0\% \leqq B \leqq 25\%$, $0\% \leqq Si \leqq 30\%$, and at least one element selected from the group consisting of niobium, tungsten, tantalum, zirconium, hafnium, titanium and molybdenum in proportions of between 0.1% and 30%, the balance being impurities resulting from smelting, the chemical composition furthermore satisfying the relationship $5\% \leqq B+Si \leqq 30\%$, comprising the steps of:

providing an amorphous ribbon comprising the iron-based soft magnetic alloy, winding the ribbon around a mandrel to form a core and provide a blank for a magnetic component, and subjecting the blank to a crystallization heat treatment comprising at least one annealing step at a temperature of between 500° C. and 600° C. for a time of between 0.1 and 10 hours so as to cause nanocrystals to form, wherein, before the crystallization heat treatment, a relaxation heat treatment is carried out at a temperature below the temperature for the onset of recrystallization of the amorphous alloy, wherein the relaxation heat treatment is a temperature hold carried out for a time of between 0.1 and 10 hours at a temperature of between 250° C. and 480° C.

2. The process as claimed in claim 1, wherein the crystallization annealing is carried out in a magnetic field.

3. The process as claimed in claim 1, wherein a complementary annealing step is carried out in a magnetic field at a temperature below the crystallization onset temperature.

4. The process as claimed in claim 1, wherein the chemical composition of the alloy is such that $Si \leqq 14\%$.

5. The process as claimed in claim 1, wherein the relaxation heat treatment is carried out at a temperature between 400° C. and 450° C.

6. The process as claimed in claim 1, wherein the relaxation heat treatment is carried out for a time between 1 and 3 hours.

* * * * *